US008783908B2

(12) United States Patent
Gross et al.

(10) Patent No.: US 8,783,908 B2
(45) Date of Patent: Jul. 22, 2014

(54) MULTIMODE FLASHLIGHT HAVING LIGHT EMITTING DIODES

(75) Inventors: Barbara R. Gross, Memphis, TN (US); Danny Joe Holmes, Collerville, TN (US)

(73) Assignee: PowerTech, Inc., Collierville, TN (US)

( * ) Notice: Subject to any disclaimer, the term of this patent is extended or adjusted under 35 U.S.C. 154(b) by 487 days.

(21) Appl. No.: 13/250,776

(22) Filed: Sep. 30, 2011

(65) Prior Publication Data

US 2012/0176780 A1 Jul. 12, 2012

Related U.S. Application Data

(63) Continuation-in-part of application No. 12/987,233, filed on Jan. 10, 2011, now Pat. No. 8,052,297.

(51) Int. Cl.
*F21L 4/02* (2006.01)

(52) U.S. Cl.
CPC .. *F21L 4/027* (2013.01); *F21L 4/02* (2013.01)
USPC ..... 362/259; 362/184; 362/205

(58) Field of Classification Search
CPC ..... F21L 4/02; F21L 4/027
USPC ..... 362/184, 205, 208, 231
See application file for complete search history.

(56) References Cited

U.S. PATENT DOCUMENTS 3,609,344 A 9/1971 So
4,823,242 A 4/1989 Maglica et al.
5,121,308 A 6/1992 Maglica et al.
5,697,695 A 12/1997 Lin et al.
6,158,874 A 12/2000 Brunstein et al.
6,474,833 B1 11/2002 Parsons et al.
6,793,366 B2 9/2004 Chun
6,814,466 B2 11/2004 Parsons et al.
7,186,002 B2 3/2007 Matthews et al.
7,220,016 B2 5/2007 Matthews et al.
7,241,025 B2 7/2007 Kim
7,293,893 B2 11/2007 Kim
2003/0095405 A1 5/2003 Parsons et al.
2005/0002186 A1 1/2005 Krieger et al.
2005/0122712 A1 6/2005 Kim
2005/0122714 A1 6/2005 Matthews et al.
2005/0128741 A1 6/2005 Matthews et al.
2005/0237734 A1 10/2005 Krieger et al.
2006/0164828 A1 7/2006 Kim
2007/0195522 A1 8/2007 Matthews et al.
2007/0247839 A1 10/2007 Matthews et al.
2012/0139452 A1* 6/2012 Galli et al. ..... 362/184

* cited by examiner

*Primary Examiner* — David V Bruce
(74) *Attorney, Agent, or Firm* — Triangle Patents, PLLC

(57) ABSTRACT

A flashlight with light emitting diode (LED) sources that produce at least two different colors and at least two other activatable components. The colored LEDs and activatable components cycle on and off using two or three separate switches. One switch cycles preferably white LEDs on and off. Another switch preferably cycles between a non-white LEDs and two other activatable components and combinations thereof. The activatable components include strobes, sirens, GPS tracking, emergency calling, radio, weather notification, laser light, and light not visible to humans. A third switch disposed on the exterior surface(s) of the body that is operable to asynchronously cycle through the functions of the white light source, wherein the functions include blinking, strobe, pre-programmed varying visible intensity, and Morse code messages.

13 Claims, 8 Drawing Sheets

MULTIMODE FLASHLIGHT HAVING LIGHT EMITTING DIODES

CROSS-REFERENCE TO RELATED APPLICATION

This non-provisional utility patent application is a continuation-in-part of U.S. application Ser. No. 12/987,233, filed on Jan. 10, 2011 now U.S. Pat. No. 8,052,297.

BACKGROUND OF THE INVENTION

1. Field of the Invention

The present invention relates generally to hand-held flashlights and more specifically to flashlights emitting multiple colors produced by light emitting diodes (LEDs).

2. Description of the Prior Art

Light emitting diodes (LEDs) have provided significant advances in portable light sources, such as flashlights. Conventional flashlights use relatively fragile incandescent lamps with a short operating life and high power consumption. In the 1950s and 1960s, the first widespread reports were published of infrared emission from a semiconductor alloy when provided with electric current, see, e.g., U.S. Pat. No. 3,293,513, to Texas Instruments, Inc., titled "Semiconductor radiant diode". LEDs are able to emit a certain wavelength of light, which at certain wavelengths, forms visible light, based on the semiconductor material. Different colors can be emitted using various materials and combinations of materials, which includes the emission of red, orange, yellow, green, blue, violet, and ultraviolet radiation.

LEDs produce more intense light per watt than do incandescent bulbs, which is useful in the technology of a flashlight that requires long-term usage and whose failure carries serious consequences. Additionally, LEDs usually fail by dimming over time, providing some warning of their impending failure to the user. LEDS may last up to 50,000 hours, whereas fluorescent tubes are rated to about 30,000 hours and incandescent bulbs average 1,000 to 2,000 hours of usage. LEDs can emit light of a certain color, which is useful in situations that require specific types and intensities of light, such as hunting, night-based research, or military operations. LEDs are dimmable and focusable, unlike incandescent and fluorescent light sources. LEDs have no detrimental effects from frequent on-off cycling. LEDs are solid-state, which makes it much more difficult to break them or make them unusable through accidents like droppage.

White light LEDs were originally produced through a combination of red, green, and blue LEDs. Currently, white light LEDs are usually modified blue LEDs which emit blue light through a yellowish phosphor coating, the result of this is a mixture of blue and yellow light which gives the appearance of white light. The newest method of producing white light LEDs uses homoepitaxially grown zinc selenide on a zinc selenide substrate, which emits blue light and yellow light simultaneously.

Currently, there are a number of flashlights on the market that use LEDs with different wavelengths of emission. Flashlights have been produced that contain multiple LED sources in a single structure. This solves the problem of needing separate flashlights for multiple modalities.

Current multi-color flashlights use a single switch to cycle through the various colors. This cycling results in the white LED being lit in every cycle. However cycling through the white light leads to safety hazards in a number of situations, including aviation, military and police applications, where preserving night vision is necessary; white light is readily picked by and intensified by standard night vision technology. Additionally, colored LEDs are thought to be invisible to many game animals and will not spook animals like white light. Other LEDs include ultraviolet (UV) and infrared (IR) LEDs as well. UV LEDs are used for identifying security holograms and markings on money, drivers' licenses and passports. IR LEDs are used in military operations with night vision apparatus to identify friendly combatants.

One configuration that avoids cycling through the white LED has three dedicated switches aligned along the same side of the handle, with each switch controlling one color. However, this configuration proves cumbersome, making the flashlight too long and expensive. Another alternative is exemplified by the "4 Color Recon Torch" flashlight made by Coast Products, Inc, which has four switches, one for each of four colored LEDs, see http://www.coastportland.com. However, these switches are spread out on opposite sides of the flashlight. While this shortens the length of the flashlight, it results in the operator not knowing which button they are pushing in the dark because the orientation of the flashlight in the operator's hand may not always be known.

A multiple switch technology is needed to regulate the colored LEDs separately from the white LED. Previous technologies do not provide satisfactory solutions. For instance, U.S. Pat. No. 7,293,893 to assignee Surefire LLC, titled "Flashlight with adjustable color selector switch," describes a flashlight having an elongated body having opposed first and second ends. A first lamp is a high-intensity variable brightness white light source located at the first end. A number of additional lamps are positioned at the first end. The additional lamps include at least two different output wavelengths different from each other and from the first lamp. A first switch on the flashlight selectively operates to select the output wavelength of the flashlight by selectively enabling different lamps based on the condition of the switch. A power storage element and control circuitry are connected to the lamps and to the switch. However, the bulb is still cycled through the white and colored LEDs by use of one switch. One would not know which color is being activated, which could accidentally lead to white being activated which may be fatal in, for instance, night military operations.

Thus, there remains a need for a multimodal flashlight with white light controlled by one switch and multiple functions controlled by a second switch, including the ability to cycle through several desired non-white colors.

SUMMARY OF THE INVENTION

A first aspect of the present invention is to provide a flashlight including: a first light source operable for producing a first output wavelength of light disposed within a body having an exterior surface(s); a first switch disposed on the exterior surface(s) of the body that activates functioning of the first light source to constant on or momentary on; and a second switch disposed on the exterior surface(s) of the body operable to asynchronously cycle through additional functions of the white light source, wherein the functions include blinking, strobe, pre-programmed varying visible intensity, Morse code messages, and combinations thereof.

A second aspect of the present invention is to provide a flashlight including: a first light source operable for producing a first output wavelength of light disposed within a body having an exterior surface(s); a second light source operating to produce a different second output wavelength of light disposed within the body; a third light source operable for producing a different third output wavelength of light disposed within the body; a first switch disposed on the exterior surface(s) of the body that activates functioning of the first light source; and a second switch disposed on the exterior surface(s) of the body that asynchronously activates functioning of either the second light source or the third light source.

A third aspect of the present invention is to provide a flashlight including: a first activatable component comprising a light source operable for producing a first output wavelength of light disposed within a body having an exterior surface(s); at least two additional activatable components disposed within the body; a first switch disposed on the exterior surface(s) of the body that is operable to activate functioning of the first activatable component; and a second switch disposed on the exterior surface(s) of the body that is operable to asynchronously activate functioning of anyone of the at least two additional activatable components.

A fourth aspect of the present invention is to provide a flashlight including: a first activatable component comprising a light source operable for producing a first output of white light disposed within a body having an exterior surface(s); at least two additional activatable components disposed within the body; a first switch disposed on the exterior surface(s) of the body that is operable to activate functioning of the first activatable component; a second switch disposed on the exterior surface(s) of the body that is operable to simultaneously activate more than one of the at least two additional activatable components; and a third switch disposed on the exterior surface(s) of the body that is operable to asynchronously cycle through functions of the white light source regardless of the setting of the first switch, wherein the functions are selected from the group of blinking, strobe, pre-programmed varying visible intensity, Morse code messages, and combinations thereof.

A fifth aspect of the present invention is to provide a flashlight including: a body, the body further including within it: a white light wavelength light source disposed within the body having an exterior surface(s); a laser light source disposed within the body; a red LED light source disposed within the body; a first switch disposed on the exterior surface(s) of the body that is operable to activate functioning of the first white light source; and a second switch disposed on the exterior surface(s) of the body that is operable to activate the laser light source; and a third switch disposed on the exterior surface(s) of the body that is operable to activate the red LED light source.

Thus, the present invention provides a hand-held flashlight operable for emitting at least two colors, including preferably white, while completely isolating control of the white light from the other colors.

These and other aspects of the present invention will become apparent to those skilled in the art after a reading of the following description of the preferred embodiment when considered with the drawings, as they support the claimed invention.

DETAILED DESCRIPTION

Figure 1:
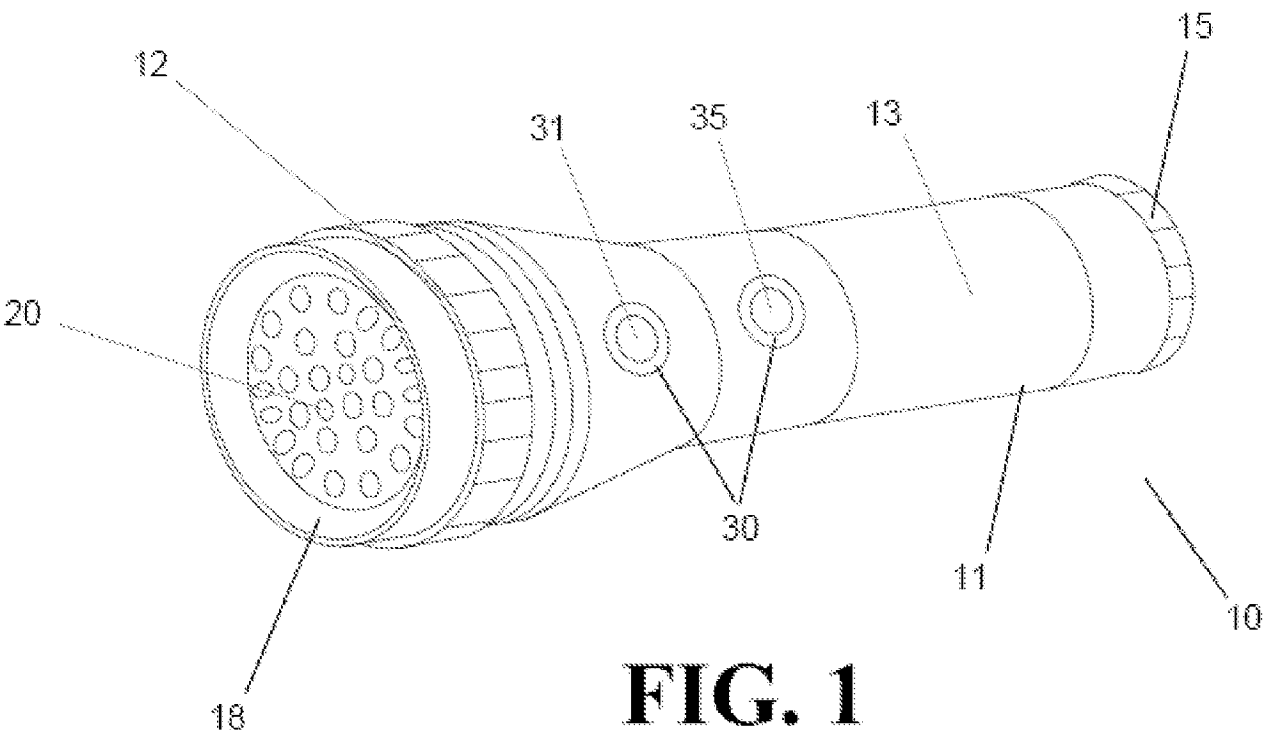
FIG. 1 is a perspective view of a hand-held flashlight according to an embodiment of the present invention.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

The present invention provides a flashlight including a body, the body having an exterior surface(s) and further including an interior; disposed, constructed and confined within it a white light wavelength light source; a first switch disposed on the exterior surface(s) of the body that activates functioning of the white light source to a constant on or momentary on; and a second switch disposed on the exterior surface(s) of the body that asynchronously cycles through the functions of the white light source. In preferred embodiments, the second switch functions are selected from the group consisting of blinking, strobe, pre-programmed varying visible intensity, Morse code messages and combinations thereof. The second switch can be located on the body or on the tailcap. The first switch can be an on/off switch or a dual-setting on/off with a momentary-on setting. The first switch can also include a "dim" setting that activates the light to a dim light mode. The switches control different aspects or functions of the same light source.

The present invention also provides a multimode flashlight with at least two switches on the body of the flashlight controlling those functions. One of those switches, a first switch, preferably is operable to cycle a white light source between on (activated) and off (deactivated) states. A second switch preferably is operable to cycle two non-white color sources through each color independently being on and then off. These non-white color sources preferably provide red and blue or red and green light, respectively. More preferably, the second switch cycles through the following states: red light source activated to blue light source activated to both red and blue light sources deactivated; or red light source activated to green light source activated to both red and green light sources deactivated. While other embodiments are contemplated, one embodiment of the present invention provides a hand-held flashlight operable for emitting at least three colors, including preferably white, while completely isolating control of the white light from the other colors. Preferably, the light sources producing these colors are light emitting diodes (LEDs).

Referring now to the drawings in general, the illustrations are for the purpose of describing a preferred embodiment of the invention and are not intended to limit the invention thereto. FIG. 1 shows the flashlight, generally referred to as 10, from a front and side view. The body of the flashlight 11 has a substantially cylindrical shape, with a lens 18 and LEDs 20 to provide a light source for lighting targets at one end and a detachable tail cap 15 for inserting or changing batteries or other power supply at the far end. Alternatively, the power source could be inserted by detaching the head and inserting the power source from the head end into the barrel. The flashlight has power switches 30 near the front end of the body's exterior surface(s) 12, with a white LED controlling switch 31 located closest to the end and the second switch 35 for controlling multiple functionalities of the white LED, the second switch being located behind the first switch. Preferably, the switches are push buttons. Pushing on the front button 31 activates a function cycle of the flashlight through on/off in the preferred embodiment. Pushing on the second button 35 will asynchronously cycles through the functions of the white light source, wherein the functions are selected from the group consisting of blinking, strobe, pre-programmed varying visible intensity, Morse code messages and combinations thereof, and these flashing functions are performed by the same light source regardless of the setting of the first switch The second switch can thus override the setting of the first switch and cause the light to strobe, blink, etc., thereby providing immediate assistance to the user by the single action of activating the second switch. The purpose of the strobe is to disorient and/or temporarily blind an assailant. Thus, it is an important feature of the present invention that the strobe function can be activated immediately and by a single, dedicated action. For this reason, the present invention is designed and configured such that the two switches control separate actions of the same light: one activates on/off, the second activates only the strobe and similar functions of the light regardless of the setting of the first switch. Importantly, and in contrast to the prior art, the switches do not have to be activated in series for the flashing functions to be activated by the second switch In an alternative embodiment, the first switch also has a lower lumen "dim" light setting that places the light in a dim light mode. In this embodiment, if the first switch has placed the light in dim mode, then when the second switch is activated it places the light in the higher lumen "bright" light mode and activates the strobe, blink, etc.

Figure 2:
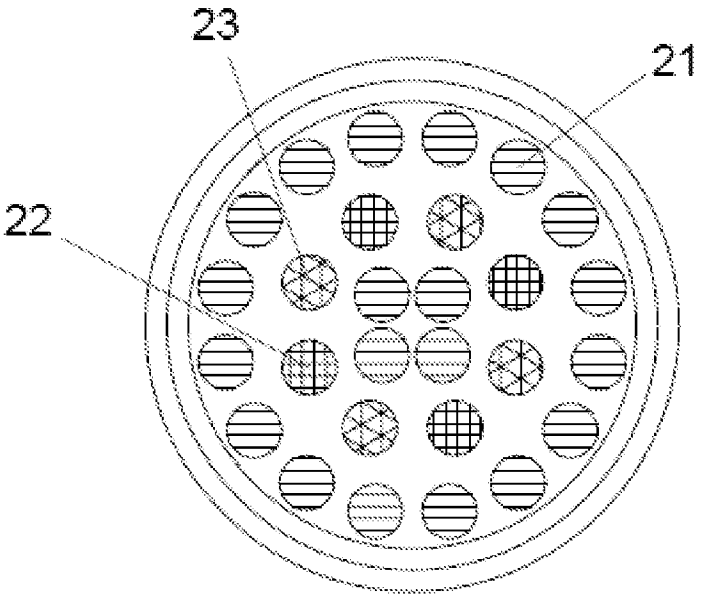
FIG. 2 is a front view of an array of LEDs operating as the light sources of the present invention, in accordance with an embodiment of the present invention.
Figure 3:
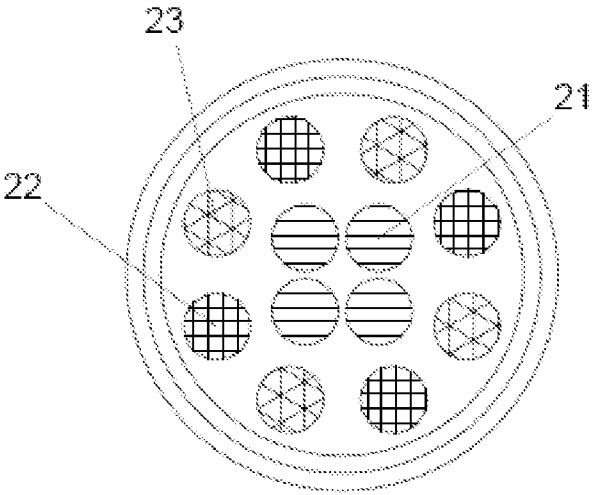
FIG. 3 is a front view of an array of LEDs operating as the light sources of the present invention, in accordance with an embodiment of the present invention.

In another embodiment, the LEDs are arrays of LEDs with different functions. For example, FIGS. 2 and 3 show an enlarged front view of two arrays of LEDs 20, either one operating as a preferred light source connected to a power supply for the present invention. In the embodiment shown in FIG. 2, the white LEDs 21 provide a white light source, and are arranged in an outer ring while the colored, non-white LEDs 22 and 23 are clustered in the center. In the embodiment shown in FIG. 3, the white LEDs 21 are clustered in the center and the non-white LEDs are arranged in an outer ring. The colored LEDs in this embodiment would include red LEDs 22 and either blue or green LEDs 23. Alternatively, the central LEDs could be substituted with a xenon bulb or a long-range high-powered focused LED operable for emitting white light, or a laser. In this alternative embodiment, the central bulb or laser would preferably be located centrally in the end of the flashlight while lower-intensity white or colored LEDs would surround the central bulb or laser.

The present invention has a body and general design similar to that of standard flashlight technology in the field; i.e. substantially cylindrical, with a housing body. The parts of the flashlight 10 include a body/barrel 11, a removable tail cap 15, switches 30, including a first switch 31 operable for on/off control of the LED cluster 20 constructed and configured in connection to a power supply; and second switch 35 for controlling multiple functions of the same LED cluster activated on/off by the first switch regardless of the setting of the first switch. The present invention also includes white LEDs 21, colored LEDs 22, a lens 18, and a battery or batteries, enclosed in the body (not shown). For more information on general structure and function of LED flashlights, see: U.S. Pat. No. 6,502,952 titled "Light emitting diode assembly for flashlights"; U.S. Pat. No. 6,331,062 titled "LED Flashlight"; U.S. Pat. No. 6,231,207 titled "Light emitting diode flashlight lamp"; and, U.S. Pat. No. 7,093,954 titled "Flashlight having LED assembly and method for producing same", all of which are herein incorporated by reference in their entirety.

The flashlight of the present invention is preferably powered by a battery or batteries that are disposed within the body 11. The tail cap 15 is removable to install or remove batteries from the flashlight 10. Preferably, the batteries are AAA sized batteries, however other sizes are contemplated by the present invention, including, AA, CR123, C, D, et cetera.

As seen in FIG. 2, the LED cluster 20 is preferably arranged with the white LEDs 21 around the outside and the colored LEDs 22 and 23 near the center. Many other numbers of LEDs and configurations are possible, including locating the colored LED bulbs anywhere in the cluster of bulbs, as illustrated in FIG. 3. The present invention also includes a combination of various white LEDs 21 along with combinations of LED bulbs of various emission colors, including infrared, red, orange, yellow, green, blue, purple, ultraviolet (UV), and infrared (IR). Alternatively, the non-white LEDs could be of the same color, or produce the same wavelength of light, where one or more produce light at a first, lower intensity and a different one or more produce light at a second, higher intensity. This variation in LED intensity between light sources of the same color could be accomplished by using, for instance, more LEDs in one set versus the other, or by using different intensity producing LEDs in one set versus the other.

The switches 30 for cycling power from the battery or batteries to the LEDs are located along the exterior surface(s) 12 of the body/barrel of the flashlight. In the present invention there are at least two switches, where the first switch 31 controls at least a first function and multiple functions are controlled by the second switch 35. In the preferred embodiment of the present invention, the upper, or first, switch 31 controls whether the white LED 21 is activated or deactivated. The second switch 35 controls at least two other functions, including color, GPS tracking, radio, siren, and etcetera. In the preferred embodiment, the second switch 35 controls activation of one set of colored LEDs 22 at a time (red/green; red/blue; blue/green; etc.).

Preferably, the switches 30 are push buttons located approximately one inch apart, as measured from their center points. Push buttons preferred over other styles of switches as they are easier to operate in conditions where gloves are worn and also protect against accidental ignition of a toggle- or dial-type switch, which can catch on gloves, clothes, holsters, or external structures. The switches 30 are each preferably circular in shape and approximately one-half of an inch in diameter and are located on the same side 13 of the flashlight's body's exterior surface(s) 12. The switches can be alternatively shaped, sized and located appropriately as needed. The switches 30 are labeled with the color of LEDs 21, 22, and 23 that they regulate. The switches 30 can also be textured for identification of function and positions or settings through tactile sensation; for instance, for use in dark conditions. Alternatively each switch may be, but without limitation: a toggle; a toggle plus a push button, the toggle of which controls the multiple non-white light functions and the push button of which controls the white light source; a dial which rotates between settings or positions to control the multiple functions, and combinations thereof.

In the foregoing embodiment, by way of example, a user could use the flashlight preferably by pressing the first button once to turn on the white light source, and then press the same button again to turn off the white light source. Further the user could also press the second button once to turn on red LEDs, and then press the same second button a second time to turn off the red LEDs. The user, upon pressing the second button a third time to turn on blue or green LEDs and then press the same button a fourth time to turn off the blue or green LEDs. Turning on one or the other of the non-white LEDs is referred to as asynchronous activation of one of those colors of LEDs. Alternatively, the user, upon pressing the second button a fifth time to turn on both the red and the blue or green LEDs. Turning on both of the non-white LEDs is referred to as simultaneous activation of both of those colors of LEDs. The forgoing colors are exemplary of both color and functions available for use with the flashlight according to the present invention and should not be viewed as limiting the scope of the present invention.

Another embodiment incorporates a strobe component within the body of the flashlight where the front switch 31 cycles through white/off and the back switch 35 cycles between non-white LEDs fully activated to strobe or flash the non-white LEDs between an activated and non-activated state at a specified frequency. The strobe component preferably is provided by electronics, incorporating for instance a capacitor or an integrated circuit that can repeatedly cycle power to another component at a specified frequency. In this embodiment, a user could press the first button once to turn on the white light source, and then press the same button again to turn off the white light source. Further the user could also press the second button once to turn on the non-white LEDs (e.g. red LEDs), then press the same second button again to cause the non-white LEDs to strobe or flash repeatedly on and off, and then press the same second button a third time to cause the non-white LEDs to turn off. The strobe component can provide emergency identification of those under duress or provides disorientation to criminals. For more information on strobe LED flashlights, see, e.g., U.S. Pat. No. 6,893,140 titled "Flashlight" which is herein incorporated by reference in its entirety.

Figure 4:
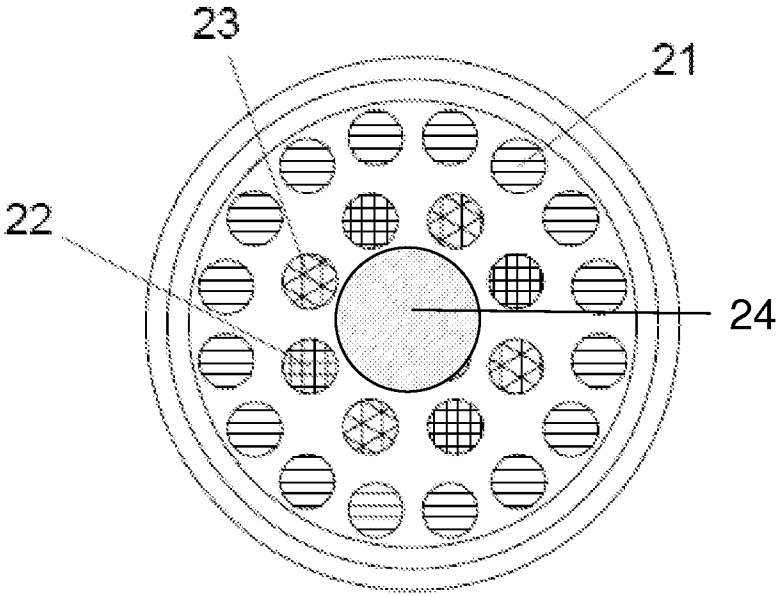
FIG. 4 is a front view of an array of LEDs and a laser operating as the light sources of the present invention, in accordance with an embodiment of the present invention.

The flashlight 10 can also include secondary or tertiary components built into the body 11. These include, but are not limited to sirens/alert sounds, GPS tracking, emergency call ability, radios, weather stations, and laser light sources. For example, as shown in FIG. 4, a laser 24 is included in the central position. These additional components are preferably cycled through using the second button as described above for the strobe component. So, according to this embodiment of present invention, a flashlight preferably combines a white light source, controlled by the first switch, with two or more of the following components, the following being controlled by the second switch: a red light source, a blue light source, a green light source, a purple light source, a yellow light source, a orange light source, an ultraviolet (UV) light source; an infrared (IR) light source; a strobe or flashing component; a siren or alert noise component, which preferably includes a speaker operable for producing a loud noise to attract attention to a user of the flashlight or to ward off would-be attackers; a GPS tracking component, which includes a GPS receiving and broadcasting device operable for receiving ones location from Global Positioning Satellites (GPS) and then broadcasting that location over the airwaves or satellite to others such that a user's location could be identified; an emergency call component, which preferably includes a cellular telephone device or a radio broadcasting device operable for calling others for assistance once activated by a user; a radio, which preferably includes a receiving antenna and a speaker operable for relaying a radio broadcast to a user; a weather station/notification component, which preferably includes a display or a speaker to notify a user of weather conditions in the user's vicinity; and/or a laser light source.

Thus, one embodiment of the present invention, as illustrated in FIGS. 1 and 2, provides a flashlight including: a first light source 21 operable for producing a first output wavelength of light disposed within a body 11 having an exterior surface(s) 12; a second light source 22 operable for producing a different second output wavelength of light disposed within the body; a third light source 23 operable for producing a different third output wavelength of light disposed within the body; a first switch 31 disposed on the exterior surface(s) of the body that is operable to activate functioning of the first light source; and a second switch 35 disposed on the exterior surface(s) of the body that is operable to asynchronously activate functioning of either the second light source or the third light source. Preferably, the first output wavelength of light, produced by the first light source is perceived as white light. Also, preferably the second output wavelength of light, produced by the second light source is perceived as red light and the third output wavelength of light is perceived as either blue or green light. The flashlight's exterior surface(s) of its body has a first side 13 and preferably the first and second switches are both further disposed on that side of the flashlight, as seen in FIG. 1. Further the first switch and the second switch are preferably push button switches. Lastly, the first light source, the second light source, and the third light source are preferably light emitting diodes (LEDs).

The present invention therefore also provides a method of using a flashlight including the following steps: 1) providing a flashlight including a first light source 21 operable for producing a first output wavelength of light disposed within a body 11 having an exterior surface(s) 12, a second light source 22 operable for producing a different second output wavelength of light disposed within the body, a third light source 23 operable for producing a different third output wavelength of light disposed within the body, a first switch 31 disposed on the exterior surface(s) of the body that is operable to activate functioning of the first light source, and a second switch 35 disposed on the exterior surface(s) of the body that is operable to asynchronously activate functioning of either the second light source or the third light source; 2) operating the first switch to activate the first light source; and 3) operating the second switch to asynchronously activate either the second light source or the third light source.

Figure 5:
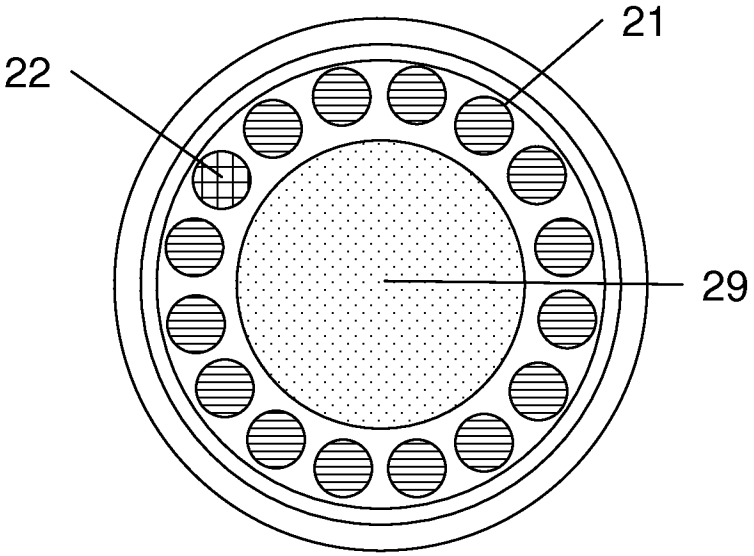
FIG. 5 is a front view of an array of LEDs and another light source operating as the light sources of the present invention, in accordance with an embodiment of the present invention.

An example of this embodiment is a flashlight shown in FIG. 5. This flashlight includes a long-range focus light 29, such as a xenon bulb or a long-range high-powered focused LED operable for emitting white light or a laser, a set of short-range, broad focus white LED illumination lights 21 and a single red LED light 22. The long-range focus is for normal, exterior operations; the short-range, broad focus white LED navigation lights are for interior navigation in low light, and the single red LED light is designed for interior navigation when the white LED navigation lights might be too bright, such as when another cockpit occupant is sleeping or when under possible surveillance by adversaries. The white LED navigation lights are low-lumen, preferably about 10 lumens or less; more preferably, about 5 lumens or less. In this embodiment, two or three switches can be used to control the different functions. For example, a first switch is used to cycle between the long-range focus light 29, the short-range white LED illumination lights, and the single red LED light 22. A second, dedicated strobe switch is provided to only activate the strobe-type functions of the long-range focus light. Alternatively, three switches can be provided. For example, the first switch can control the white light illumination, the second switch the red LED, and the third switch the flashing functions of the white light.

Figure 6:
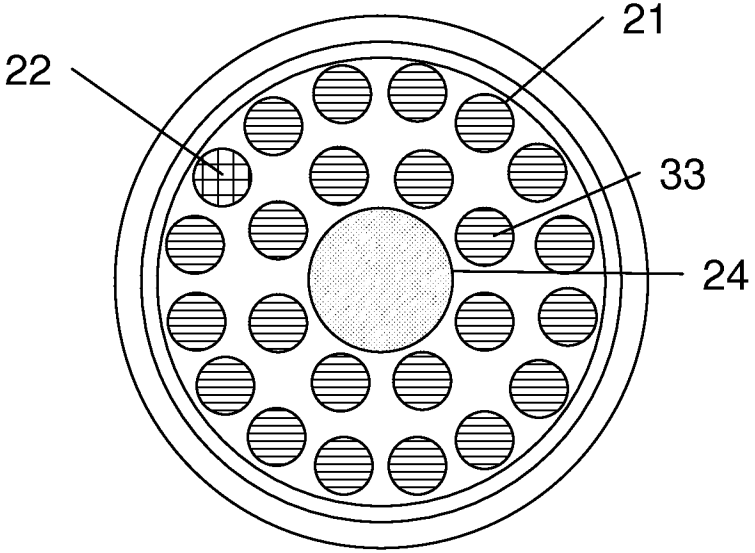
FIG. 6 is a front view of an array of LEDs and a laser operating as the light sources of the present invention, in accordance with an embodiment of the present invention.

Another example flashlight is shown in FIG. 6. In this figure, a flashlight according to the present invention includes an emergency laser 24, a first set of short-range, broad focus white LED illumination lights 21, a second set of short-range, broad focus white LED illumination lights 33, and a single red LED light 22. This embodiment provides an emergency laser at the expense of a xenon-type bulb, but compensates with extra white LED lights to increase the short-range, broad focus white light. In this embodiment, two or three switches can be used to control the different functions. For example, a first switch is used to cycle between the long-range focus light 29, the first set of short-range white LED illumination lights 21; the second set of white LED illumination lights 33; and the single red LED light 22. A second switch is provided to activate the flashing functions of the long-range focus light. Alternatively, three switches can be provided, the first switch controlling the long-range focus light 29, the second switch cycling between the first set of short-range white LED illumination lights 21, the second set of white LED illumination lights 33 and the single red LED light 22; and a third switch is used to control the flashing functions of the long-range focus light.

Figure 7:
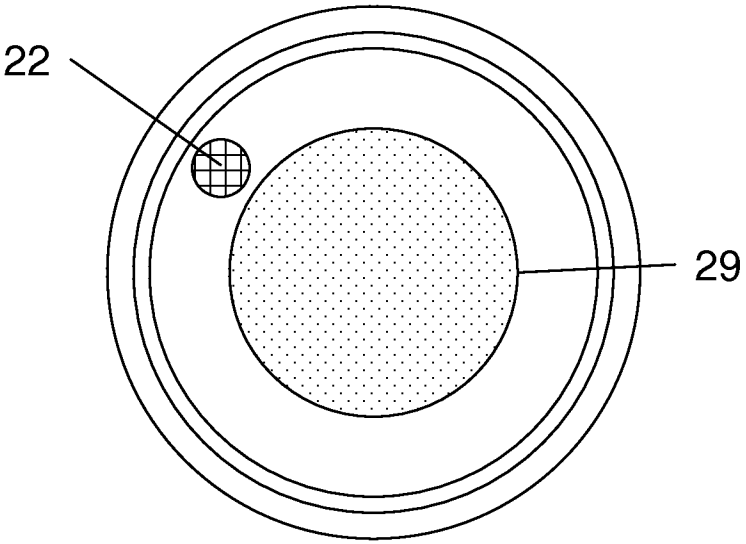
FIG. 7 is a front view of a hand-held flashlight according to another embodiment of the present invention.

Another example flashlight is shown in FIG. 7. In this figure, a flashlight according to the present invention includes a single long-range focused white light that is dimmable, such as a xenon bulb 29 or a long-range high-powered focused LED, and a single red LED light 22. The long-range focus white light is for normal, exterior operations and is dimmable for interior navigation in low light. The single red LED light is designed for interior navigation when the dimmed white light might be too bright, such as when another cockpit occupant is sleeping or when under possible surveillance by adversaries. The white light is preferably dimmable. In this embodiment, two or three switches can be used to control the different functions. For example, a first switch is used to activate or control the long-range focus light 29. A second switch is used to cycle the single red LED light 22 and the short-range white LED illumination lights. Alternatively, three switches can be provided, each controlling one of the three different forms of illumination.

Another embodiment according to the present invention provides a flashlight including: a first activatable component including a light source operable for producing a first output wavelength of light disposed within a body having an exterior surface(s); at least two additional activatable components disposed within the body; a first switch disposed on the exterior surface(s) of the body that is operable to activate functioning of the first activatable component; and a second switch disposed on the exterior surface(s) of the body that is operable to asynchronously activate functioning of anyone of the at least two additional activatable components. Preferably, in this embodiment, one of the at least two additional activatable components is a second light source operable for producing a different second output wavelength of light and another one of at least two additional activatable components is a third light source operable for producing a different third output wavelength of light. Alternatively, one of the at least two additional activatable components is one or more of the following: a strobe component operable for causing the second light source to repetitively activate and deactivate; a siren component operable for producing a noise; a GPS tracking component; an emergency call component; a radio component; a weather notification component; a laser light source; or a second light source operable for producing light not visible by humans, such as ultraviolet (UV) or infrared (IR) light. Alternatively, one of the at least two additional activatable components is a second light source operable for producing a different second output wavelength of light at a light intensity and another one of at least two additional activatable components is a third light source operable for producing the different second output wavelength of light at a different light intensity.

A further embodiment according to the present invention provides a flashlight including: a first activatable component including a light source operable for producing a first output wavelength of light disposed within a body having an exterior surface(s); at least two additional activatable components disposed within the body; a first switch disposed on the exterior surface(s) of the body that is operable to activate functioning of the first activatable component; and a second switch disposed on the exterior surface(s) of the body that is operable to simultaneously activate functioning of anyone of the at least two additional activatable components.

Figure 8:
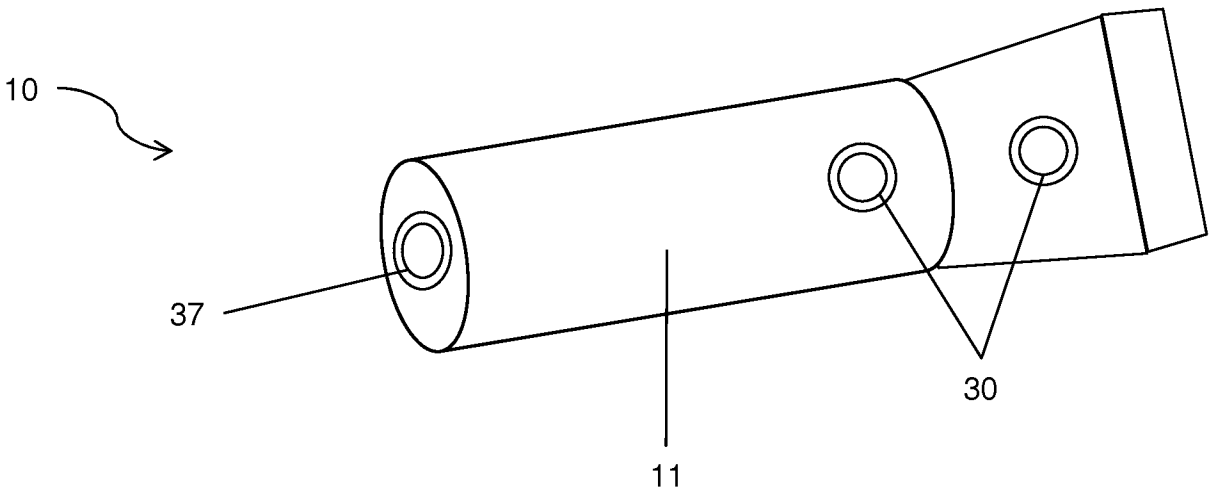
FIG. 8 is a perspective view of a hand-held flashlight according to another embodiment of the present invention.

Another embodiment according to the present invention provides a flashlight with light emitting diode (LED) sources that produce at least two different colors and at least two other activatable components. The colored LEDs and activatable components cycle on and off using two or three separate switches. One switch cycles preferably white LEDs on and off. Another switch preferably cycles between a non-white LEDs and two other activatable components and combinations thereof. The activatable components include strobes, sirens, GPS tracking, emergency calling, radio, weather notification, laser light, and light not visible to humans. As shown in FIG. 8, a third switch 37 disposed on the exterior surface(s) of the body is operable to asynchronously cycle through the functions of the white light source, wherein the functions can include blinking, strobe, pre-programmed varying visible intensity, Morse code messages and combinations thereof. The third switch 37 can be located on the main body of the flashlight or on the tailcap, as shown in FIG. 8.

Certain modifications and improvements will occur to those skilled in the art upon a reading of the foregoing description. By way of example, the energy for operation of the flashlight could come from a rechargeable battery system, battery pack or the flashlight 10 could itself be plugged directly into the wall. Also, the flashlight may be adapted to be mounted to another object with, for instance, a magnet, clamp, and/or hook-and-loop mechanism, and the like. The objects to which the flashlight may be mounted include vehicles, hardhats, military helmets, garments, and the like. Also, the switches can be made to operate in series to prevent the inadvertent activation of the flashing functions. The above mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the following claims.

What is claimed is:

1. A flashlight comprising:

a. a body, the body having an exterior surface(s) and further including within it:

b. a white light wavelength light source disposed within the body and connected to a power source;

c. a first switch disposed on the exterior surface(s) of the body or tailcap that is operable to activate the white light source between "on" and "off"; and d. a second switch disposed on the exterior surface(s) of the body that is operable to strobe the white light source regardless of the setting of the first switch.

2. The flashlight of claim one, wherein the white light source further include functions selected from the group consisting of blinking, pre-programmed varying visible intensity, Morse code messages, and combinations thereof and the second switch is operable to asynchronously cycle through the functions of the white light source.

3. A flashlight comprising:

a. a body, the body having an exterior surface(s) and further including within it:

b. a first white light wavelength light source disposed within the body;

c. a second wavelength light source disposed within the body;

d. a first and a second activatable non-illuminatory emergency component within the body;

e. a first switch disposed on the exterior surface(s) of the body or tailcap that is operable to activate and deactivate functioning of the first white light source only to on and off modes;

f. a second switch disposed on the exterior surface(s) of the body that is operable to asynchronously cycle through the activation of the second wavelength light source, the first activatable component, the second activatable component and combinations thereof.

g. a third switch disposed on the exterior surface(s) of the body that is operable to asynchronously cycle through functions of the white light source regardless of the setting of the first switch, wherein the functions are selected from the group of blinking, strobe, pre-programmed varying visible intensity, Morse code messages, and combinations thereof.

4. The flashlight of claim 3, wherein the second activatable component is a single red LED.

5. The flashlight of claim 3, wherein another one of the at least two additional activatable components is a strobe component operable for causing the second light source to repetitively activate and deactivate.

6. The flashlight of claim 3, wherein one of the at least two additional activatable components is a siren component operable for producing a noise.

7. The flashlight of claim 3, wherein one of the at least two additional activatable components is a GPS tracking component.

8. The flashlight of claim 3, wherein one of the at least two additional activatable components is an emergency call component.

9. The flashlight of claim 3, wherein one of the at least two additional activatable components is a radio component.

10. The flashlight of claim 3, wherein one of the at least two additional activatable components is a weather notification component.

11. The flashlight of claim 3, wherein one of the at least two additional activatable components is a laser light source.

12. The flashlight of claim 3, wherein one of the at least two additional activatable components is a second light source operable for producing light not visible by humans.

13. A flashlight comprising:

a. a body, the body further including within it:

b. a white light wavelength light source disposed within the body having an exterior surface(s);

c. a laser light source disposed within the body;

d. an red LED light source disposed within the body;

e. a first switch disposed on the exterior surface(s) of the body that is operable to activate functioning of the first white light source; and f. a second switch disposed on the exterior surface(s) of the body that is operable to strobe the white light source regardless of the setting of the first switch and activate the laser light source; and g. a third switch disposed on the exterior surface(s) of the body that is operable to activate the red LED light source.

* * * * *